United States Patent [19]

Gibson et al.

[11] Patent Number: 4,464,989

[45] Date of Patent: Aug. 14, 1984

[54] INTEGRAL LOW-ENERGY THERMITE IGNITER

[75] Inventors: Albert Gibson, Dayton; Lowell D. Haws, Springboro; Jonathan H. Mohler, Spring Valley, all of Ohio

[73] Assignee: The United States of America as represented by the United States Department of Energy, Washington, D.C.

[21] Appl. No.: 494,487

[22] Filed: May 13, 1983

[51] Int. Cl.[3] ..... F42C 19/12

[52] U.S. Cl. ..... 102/202; 102/202.5; 149/15; 149/22; 149/37

[58] Field of Search ..... 102/202, 202.5; 149/15, 149/22, 37

[56] References Cited

U.S. PATENT DOCUMENTS

| | | | |
|---|---|---|---|
| 3,392,673 | 7/1968 | King | 102/202 |
| 3,669,020 | 6/1972 | Waite et al. | 149/15 |
| 3,880,595 | 4/1975 | Timmerman | 149/15 |
| 4,013,061 | 3/1977 | Trumble et al. | 149/15 |

*Primary Examiner*—Stephen J. Lechert, Jr.

*Attorney, Agent, or Firm*—Armand McMillan; Albert Sopp; Michael F. Esposito

[57] ABSTRACT

In a thermite igniter/heat source comprising a container holding an internal igniter load, there is provided the improvement wherein the container consists essentially of consumable consolidated thermite having a low gas output upon combustion, whereby upon ignition, substantially all of the container and said load is consumed with low gas production.

12 Claims, 1 Drawing Figure

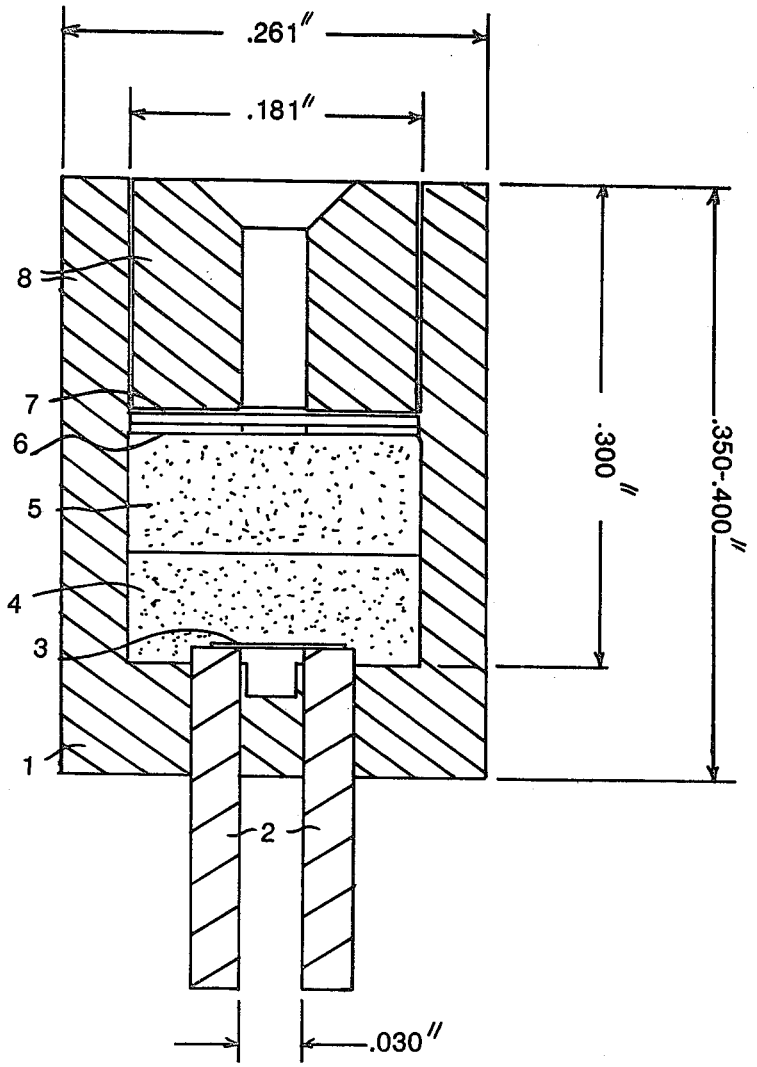
.261″
.181″
8
7
6
5
4
3
1
2
.300″
.350-.400″
.030″

INTEGRAL LOW-ENERGY THERMITE IGNITER

The U.S. Government has rights in this invention pursuant to Contract No. DE-AC04-76DP00053 between the U.S. Department of Energy and Monsanto Research Corporation (Mound Facility).

BACKGROUND OF THE INVENTION

This invention relates to a new low-energy integral thermite igniter/heat source, e.g., for use in igniting larger charges, e.g., propellant charges. The device of this invention is highly efficient especially in terms of energy output versus the amount of material utilized and also has advantageously low gas output.

Various types of igniters are well known. In all prior art devices, there is a non-combustible portion of the igniter which is used to contain the combustible portion. As a result, the energy output of the device as a function of weight and cost of materials is inherently limited. Moreover, most prior art igniters cause evolution of gas which can be very disadvantageous in many uses.

Several such prior art devices are disclosed in U.S. Pat. Nos. 2,777,389; 2,912,931; 3,392,673; 3,434,426; 3,570,405; and 2,743,580. All of these patents disclose igniters having one or several significant disadvantages.

For example, in U.S. Pat. No. 2,777,389, an inert structural material contains a high explosive. The inert structural material inherently dilutes the available energy and reduces the space and the weight efficiency of the device. Of course, this device is explosive, in contrast to the device of our invention. Moreover, the device of this patent incorporates organic polymers which inherently require that a gas will be generated during the explosion.

U.S. Pat. No. 2,912,931 discloses a device which has a combustible container. However, a significant portion of the mechanism is mechanical and non-combustible. The device is used to generate a gas for starting oil wells; thus, it is designed to produce significant amounts of gas and utilizes high gas-yield organic materials and large device sizes.

U.S. Pat. No. 3,392,673 discloses an igniter which is completely consumed. However, the ignition of the containing tube occurs after the igniter has performed its function. Thereby, the weight of the overall device is reduced after ignition. The combustion of the igniter tube does not contribute to the output of the igniter; hence, space, weight and energy efficiency is not enhanced. In addition, many of the operating components are organic, gas-producing materials some of which are not consumable. Again, the device is of a relatively large size.

U.S. Pat. No. 3,434,426 eliminates the need for a separate hot wire igniter by bonding igniter composition directly to propellant surface. Thus, it is necessary to modify the fuse system. The containment deflagration of this invention is not involved.

Accordingly, there continues to be a need for enhancing space, weight, energy etc. efficiency of thermite igniter/heat source devices as well as to minimize the amount of gas which is output upon ignition.

SUMMARY OF THE INVENTION

Accordingly, it is an object of this invention to provide a new thermite igniter/heat source which has optimized space, weight, and energy efficiency.

It is another object of this invention to provide such a device which has minimal gas output upon ignition.

It is a further object of this invention to provide such a device in which as much of the device as possible is consumed during ignition and, hence, contributes to the energy output.

Upon further study of the specification and appended claims, further objects and advantages of this invention will become apparent to those skilled in the art.

These objects have been achieved by providing in a thermite igniter/heat source comprising a container holding an internal igniter load, the improvement wherein the container consists essentially of consumable consolidated thermite having a low gas output upon combustion, whereby, upon ignition, substantially all of the container and said load is consumed with low gas production.

BRIEF DESCRIPTION OF THE DRAWING

Various other objects, features and attendant advantages of the present invention will be more fully appreciated as the same becomes better understood when considered in conjunction with the accompanying drawing, wherein:

The FIGURE is one typical thermite igniter/heat source device of this invention.

DETAILED DISCUSSION OF THE INVENTION

The device of this invention achieves a significantly increased space, weight, energy etc. efficiency in igniter/heat sources primarily due to the inherent containment deflagration which is achieved. That is, the container used to hold the conventional igniter load itself is ignitable, i.e., combustible and contributes significantly to the entire energy output. Consequently, for the same igniter load in the container, a significantly enhanced energy output is achieved; on the other hand, a given energy output can be achieved using a smaller load.

The gas output of the device of this invention is advantageously low since all materials have an inherent low gas output upon ignition. For example, using a consolidated thermite with a density of 70% of the theoretical maximum, a peak pressure of 217 psi was observed with a final pressure of 80 psi. For higher densities, the pressures will be even lower, e.g., less than about 50 psi. Moreover, the entire system is non-explosive and yet highly exothermic. The main charge is ignited with high efficiency and reliability. Accordingly, the devices are applicable to all conventional systems utilizing such thermite igniter/heat sources, e.g., in place of conventional propellant igniters.

Upon ignition, essentially all of the thermite igniter/heat source of this invention is consumed, i.e., combusts and contributes to the energy output of the device except for the conventional electrodes and fuse, e.g., hot wire, of the system. The igniter systems per se can be made in any conventional size, precise measurements, of course, being determined by the particular end use. Typical sizes are shown in the FIGURE. Generally, the igniters will be fabricated in the size range wherein the minimum overall dimension will be about 250 mils and the largest overall dimension will be about 4 inches. Of course, smaller and larger dimensions can be employed where dictated by the end use. Wall thicknesses for the container are entirely non-critical, e.g., about 0.040–0.2 inch.

The container walls are fabricated from consolidated thermite. Such consolidated thermite materials can be fabricated by using conventional hot pressing techniques on thermite powders. The fabrication of consolidated thermites is disclosed in detail, e.g., in "Consolidated $Al/Cu_2O$ Thermites", Haws et al., Monsanto Research Corporation, Mound Facility, Report No. MLM-2531(OP), Sept. 28, 1978, whose entire disclosure is incorporated by reference herein. Typically, such hot pressing is carried out at temperatures of about 425°-500° C., preferably 460°-500° C., under pressures of about 10,000 psi, for times of about 15-30 minutes. Lower or higher values, however, will be operational. These conditions can be chosen to achieve 100% of the theoretical maximum density, e.g., by utilizing pressures higher than the 10,000 psi value mentioned. Using the latter pressure, theoretical maximum densities of about 80-85% are readily achieved. In general, the percent of theoretical maximum density must be at least sufficient so that the consolidated thermite has sufficient mechanical integrity for its use as a container for the internal igniter load of the thermal igniter/heat source of this invention.

The manufacture of consolidated thermites can also be achieved using hot isostatic pressing techniques.

Generally, the hot pressing is carried out using a fully conventional die or mold system and fully conventional methodology normally utilized to fabricate desired shapes for hot pressed articles. Similarly, fully conventional considerations are employed when milling, machining or otherwise working with the consolidated thermites of this invention. Particularly, certain safety procedures should be followed as detailed in the Haws et al. report mentioned above. Any shape, normally dictated by the end use, can be employed. Typically, such shapes include cup shapes, cylindrical shapes, hemispherical shapes, rectangular shapes, etc.

In general, any of the conventionally available thermitic powders can be employed as the basic constituents of the container walls of this invention as long as they are employed in consolidated form. Typically, these thermite powders are high temperature stable inorganic materials which are intimate mechanical mixtures of an active metal whose oxide possesses a high heat of formation and a metal oxide of much lower heat of formation that is easily reduced. Usually, aluminum is the reducing metal. In such a case, the reaction is called aluminothermic. By varying the particular combination of metal oxide and metal, a wide range of thermal outputs can be achieved. Typical aluminum-containing thermite mixtures are disclosed in Table I below.

TABLE I

THERMITIC COMBINATION OF ALUMINUM WITH SELECTED METAL OXIDES

| Metal Oxide | Thermal Output (kcal/g) | Thermal Output (kcal/cm$^3$) |
|---|---|---|
| $MnO_2$ | 1.15 | 4.6 |
| $MoO_3$ | 1.10 | 4.2 |
| CuO | 0.98 | 5.0 |
| $Fe_2O_3$ | 0.95 | 4.0 |
| $Fe_3O_4$ | 0.87 | 3.7 |
| $PbO_2$ | 0.73 | 5.1 |
| $Cr_2O_3$ | 0.63 | 2.6 |
| $WO_3$ | 0.69 | 3.8 |
| $Cu_2O$ | 0.58 | 3.1 |
| $Pb_3O_4$ | 0.47 | 3.5 |
| NiO | 0.83 | 4.3 |

All of these combinations, as well as many others which will be apparent to those skilled in the art, produce minimum gas pressure upon reaction and thus provide the desired pyrotechnic, low gas-generating material. Especially preferred is the system $Al/Cu_2O$.

Typically, the weight percent content of the metal is 10-25% and of the metal oxide is 90-75%; preferably 10-15 wt % of the metal is employed and 90-85 wt % of the metal oxide is employed. Preferably, the metal is aluminum.

As shown in the FIGURE, the container 1 is usually fabricated with two conventional electrodes 2 penetrating from the outside through its walls into the inside container space. A conventional fuse 3 is used to connect the two electrodes. This provides a convenient and conventional means for igniting the internal components of the container. Suitable internal igniter mixes and configurations include all of those heretofore useful in conjunction with thermite igniter/heat source systems. One particular such configuration is shown in the FIGURE.

In the FIGURE, a consolidated thermite container 1 of this invention is equipped with conventional electrodes 2 and a fully conventional hot wire 3. In a particularly preferred application, the electrode leads are made of 0.030 inch Kovar coated with a conventional high-temperature insulation such as Saureisen. The hot wire is also fully conventional, typically a Tophet C wire. In immediate contact with the hot wire is conventional primer mix 4. Packed thereover is a conventional low density thermite 5. A thermal barrier 6 is used to cover the low density thermite, again, as is fully conventional. Over that, in the particular configuration shown in the FIGURE, is a conventional burnable barrier 7. At the top of the container is a substantially cylindrically shaped mass of consolidated thermite 8 having a hole at its center of about 0.040 inch in diameter. This consolidated thermite 8 can be any of the consolidated thermite powders mentioned above in conjunction with the container walls. This component can also be fabricated using the same procedures discussed above and disclosed in detail in Haws et al. The various characteristics of this consolidated thermite 8 are more or less the same as those of the container wall except, of course, that mechanical integrity is not as important for use in the internal igniter load. For example, lower percentages of theoretical maximum density can be employed, e.g., in the range of about 75%.

As mentioned, the particular configuration of the FIGURE is presented only by way of example and illustration and in no way is intended to limit this invention in any way whatsoever. As usual, the only basic requirement for the suitability of an igniter mix and an igniter mix configuration for use in this invention is that it produce sufficient output to get the entire thermitic reaction started.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

EXAMPLE 1

A cylindrical cup as shown in the FIGURE is pressed into its net shape using the procedures of Haws et al. cited and incorporated by reference above. The electrodes were incorporated during the pressing operation by drilling out the bottom punch to allow the Kovar wires to extend into the pressing. At that time, the top punch was pressed through the thermite powder to make contact with the electrodes. Because of the electrical conductivity of pressed thermite, the electrodes were insulated with a high temperature coating prior to being incorporated into the igniter. "Sauereisen" was used for this purpose; other equivalent insulating materials such as other glass-like coatings are fully equivalent for use. After cleaning the retained thin layer of thermite off of the ends of the electrodes protruding into the inside of the container, a Trophet C wire was conventionally welded to the two ends.

With reference to the FIGURE, the internal load, i.e., igniter mix, low density primer, insulating and burnable barriers, and output charge, etc. were chosen from various conventional combinations. In one particular configuration, the igniter mix was B/$CaCrO_4$ and the primer charge was CuO/Al powder. These were cold pressed to approximately 50% of their theroretical maximum density using 50 lbs. of force. The insulating, i.e., thermal, barrier was 2.5 mil thick teflon and the burnable barrier was 2 mil Pd/Al foil. The output charge (consolidated thermite) was CuO/Al hot pressed to 70% of its theoretical maximum density. The 40 mil center hole in the consolidated thermite output charge was incorporated during pressing and the tapered opening was machined, both functions being carried out in accordance with the details of the Haws et al. reference discussed above.

Three such igniters were tested using a 14 volt DC power supply and three were tested using a 2.0 volt, 20 A, 2 msec pulse system. In all cases, complete burn was obtained. Similar igniters having ceramic instead of thermite cups were tested at −40° C. A 50/50 fire/fail ratio was observed.

As is well known, the thermal yield of B/$CaCrO_4$ is 875 cal/g (Unidynamics Document #MTR-234, "Evaluation of 13 Boron/Calcium Chromate Blends", p. 4). The burn rate of B/$CaCrO_4$ loaded at 1.562 g/$cm^3$ ranges from 0.081 m/sec to 3.172 m/sec depending on the surface and particle size characteristics of the components. Optimization of the igniter is performed fully conventionally, e.g., after determining the effect of burn rate on performance parameters.

The same experiment was repeated using other igniter mixes which gave even better low temperature ignitability, especially for Ti/B/$CaCrO_4$.

The preceding example can be repeated with similar success by substituting the generically or specifically described reactants and/or operating conditions for this invention for those used in the preceding example. From the foregoing description, one skilled in the art can easily ascertain the essential characteristics of this invention, and without departing form the spirit and scope thereof, can make various changes and modifications of the invention to adapt it to various usages and conditions.

What is claimed is:

1. In a thermite igniter/heat source comprising a container holding an internal igniter load, the improvement wherein the container consists essentially of consumable consolidated thermite having a low gas output upon combustion, whereby upon ignition, substantially all of the container and said load is consumed with low gas production.

2. A thermite igniter/heat source of claim 1, wherein the consolidated thermite is a combination of aluminum metal and $MnO_2$, $MoO_3$, CuO, $Fe_2O_3$, $Fe_3O_4$, $PbO_2$, $Cr_2O_3$, $WO_3$, $Cu_2O$, $Pb_3O_4$, NiO or a mixture thereof.

3. A thermite igniter/heat source of claim 1, wherein the consolidated thermite is a combination of aluminum metal and CuO, $Fe_2O_3$, $Fe_3O_4$, $Cu_2O$, NiO or a mixture thereof.

4. A thermite igniter/heat source of claim 1, wherein the consolidated thermite is a combination of aluminum metal and $Cu_2O$.

5. A thermite igniter/heat source of claim 1, wherein the consolidated thermite is a combination of about 11 weight percent of Al and about 89 weight percent of $Cu_2O$.

6. A thermite igniter/heat source of claim 1, wherein the consolidated thermite is prepared by hot pressing thermite powder.

7. A thermite igniter/heat source of claim 1, wherein the smallest dimension of the container is about 250 mils.

8. A thermite igniter/heat source of claim 1, wherein the largest dimension of the container is about 4 inches.

9. A thermite igniter/heat source of claim 1, wherein the container has side walls and a bottom wall and which further comprises, two electrodes passing through the bottom wall into the inside of the container, and a fuse inside the container and in contact with the ends of the two electrodes which are inside the container.

10. A thermite igniter/heat source of claim 9, wherein the container has cylindrical side walls and wherein the internal igniter load comprises discrete, compositionally distinct zones.

11. A thermite igniter/heat source of claim 10, wherein said internal igniter load comprises a primer mix in contact with said fuse, a low density thermite mix over said primer mix, a thermal barrier over said low density thermite mix, a burnable barrier over said thermal barrier, and a consolidated thermite charge over said burnable barrier.

12. A thermite igniter/heat source of claim 6, wherein the consolidated thermite is hot-pressed at 460°–500° C. and at least 10,000 psi for 15–30 minutes to achieve 80–100% of theoretical maximum density.

* * * * *